US008795025B1

(12) United States Patent
Hunt et al.

(10) Patent No.: US 8,795,025 B1
(45) Date of Patent: Aug. 5, 2014

(54) INFANT MANNEQUIN

(76) Inventors: Angie Hunt, Russelville, AR (US); Tim Hunt, Russelville, AR (US)

( * ) Notice: Subject to any disclaimer, the term of this patent is extended or adjusted under 35 U.S.C. 154(b) by 188 days.

(21) Appl. No.: 13/464,891

(22) Filed: May 4, 2012

(51) Int. Cl.
*A63H 3/28* (2006.01)

(52) U.S. Cl.
USPC ..... 446/297

(58) Field of Classification Search
CPC ..... A63H 3/28; A63H 3/003; A63H 9/00; A63H 2200/00
USPC ..... 446/297
See application file for complete search history.

(56) References Cited

U.S. PATENT DOCUMENTS

| | | | | |
|---|---|---|---|---|
| 4,795,397 | A | 1/1989 | Stevens | |
| 5,256,098 | A * | 10/1993 | Smith et al. | 446/28 |
| 5,257,955 | A | 11/1993 | Jones | |
| 5,403,224 | A | 4/1995 | Gintling | |
| 5,607,337 | A | 3/1997 | Callahan | |
| D388,480 | S | 12/1997 | Toft | |
| 5,842,900 | A | 12/1998 | Hodge | |
| 5,947,791 | A | 9/1999 | Taylor | |
| 6,050,826 | A * | 4/2000 | Christianson et al. | 434/262 |
| 6,604,980 | B1 * | 8/2003 | Jurmain et al. | 446/296 |
| 6,699,045 | B2 * | 3/2004 | Christianson et al. | 434/262 |
| RE39,791 | E * | 8/2007 | Jurmain et al. | 434/238 |
| D560,732 | S | 1/2008 | Wallis | |
| 2008/0090490 | A1 | 4/2008 | Barrows et al. | |

* cited by examiner

*Primary Examiner* — Kurt Fernstrom
*Assistant Examiner* — Dolores Collins

(57) ABSTRACT

A novel infant mannequin system for documenting features of a specific human infant comprises a infant head form with two eye members, a nose member, a mouth aperture having two lips, and a head form having a facial image of a specific human infant. The system comprises an infant body form, a skeletal structure, a muscular structure, a skin covering, and a hair receptacle system located on the head form. The system comprises an abdomen compression diaphragm located underneath the skin covering. A function simulation system comprises a microprocessor, a power source, a data port and an activation switch located in the torso. The function simulation system comprises a heartbeat output simulator, a thermal circulation system, an abdominal expansion system, and a sound generator. A body weight distribution member is located in the skeletal structure.

2 Claims, 3 Drawing Sheets

INFANT MANNEQUIN

BACKGROUND OF THE INVENTION

Babies capture the hearts and minds of those that surround them during their stages of development, but grow so quickly that their family may not have time to fully enjoy these times. Photo, videos and mementos such as locks of hair or baby teeth help to remind those involved in the baby's life of these cherished times, but these items are limited to two dimensional images or isolated tokens. The present invention teaches a system to capture numerous characteristics of an infant in a specific stage of life in a life like three dimensional simulation form.

SUMMARY

The present invention features a novel infant mannequin system for documenting features of a specific human infant, in some embodiments, the system comprises a humanoid infant head form having a generally spherical, generally bilaterally symmetrical shape. In some embodiments, the head form comprises two eye members, a nose member, a mouth aperture having two lips, and a head form having a facial image of a specific human infant. In some embodiments, the system comprises a humanoid infant body form having a generally bilaterally symmetrical shape.

In some embodiments, the system comprises a humanoid skeletal structure with a generally bilaterally symmetrical shape. In some embodiments, the system comprises a humanoid muscular structure with a generally bilaterally symmetrical shape. In some embodiments, the system comprises a humanoid skin covering located over and fully enveloping the skeletal structure and the muscular structure.

In some embodiments, the system comprises a hair receptacle system located on the skin covering located on the head form. In some embodiments, the hair receptacle system is for receiving, holding, positioning and displaying a lock of human infant hair. In some embodiments, the system comprises an abdomen compression diaphragm located on the skeletal structure underneath the skin covering. In some embodiments, the abdomen compression diaphragm spans an abdominal cavity front opening. In some embodiments, the abdomen compression diaphragm is elastically compressible.

In some embodiments, a function simulation system comprises a microprocessor, a power source, a data port and an activation switch located in the torso. In some embodiments, the function simulation system comprises a heartbeat output simulator located in the torso underneath the skin covering. In some embodiments, the function simulation system comprises a thermal circulation system. In some embodiments, the function simulation system comprises an abdominal expansion system located in the torso. In some embodiments, the function simulation system comprises a sound generator located in the torso.

In some embodiments, a body weight distribution member is located in the skeletal structure.

Any feature or combination of features described herein are included within the scope of the present invention provided that the features included in any such combination are not mutually inconsistent as will be apparent from the context, this specification, and the knowledge of one of ordinary skill in the art. Additional advantages and aspects of the present invention are apparent in the following detailed description and claims.

DESCRIPTION OF PREFERRED EMBODIMENTS

Following is a list of elements corresponding to a particular element referred to herein:

| | |
|---|---|
| 100 | Infant mannequin system |
| 120 | Birth record |
| 130 | Hospital bracelet |
| 200 | Head form |
| 210 | Eye member |
| 220 | Nose member |
| 230 | Mouth aperture |
| 240 | Lips |
| 250 | Facial image |
| 300 | Body form |
| 310 | Torso |
| 320 | First leg |
| 325 | First foot |
| 330 | First arm |
| 335 | First hand |
| 340 | Torso first side |
| 350 | Second leg |
| 355 | Second foot |
| 360 | Second arm |
| 365 | Second hand |
| 370 | Torso second side |
| 330 | Torso top |
| 390 | Torso chest area |
| 400 | Skeletal structure |
| 410 | Rigid member |
| 420 | Rigid member first connection point |
| 430 | Rigid member second connection point |
| 440 | Moveable joint |
| 450 | Skull member |
| 460 | Abdominal cavity front opening |
| 470 | Torso skeletal member |
| 500 | Muscular structure |
| 510 | Elastic member |
| 520 | Elastic member first end |
| 530 | Elastic member second end |
| 600 | Skin covering |
| 700 | Hair receptacle system |
| 800 | Abdomen compression diaphragm |
| 900 | Function simulation system |
| 910 | Microprocessor |
| 912 | Power source |
| 914 | Data port |
| 916 | Activation switch |
| 920 | Heartbeat output simulator |
| 930 | Thermal circulation system |
| 932 | Circulation fluid |
| 934 | Capillary network |
| 936 | Heater |
| 938 | Temperature sensor |
| 940 | Circulation fluid pump |
| 950 | Abdominal expansion system |
| 952 | Abdominal bladder assembly |
| 954 | Connective tubing |
| 956 | Abdominal electric motor |
| 960 | Sound generator |
| 965 | Speaker |
| 970 | Body weight distribution member |

Figure 1:
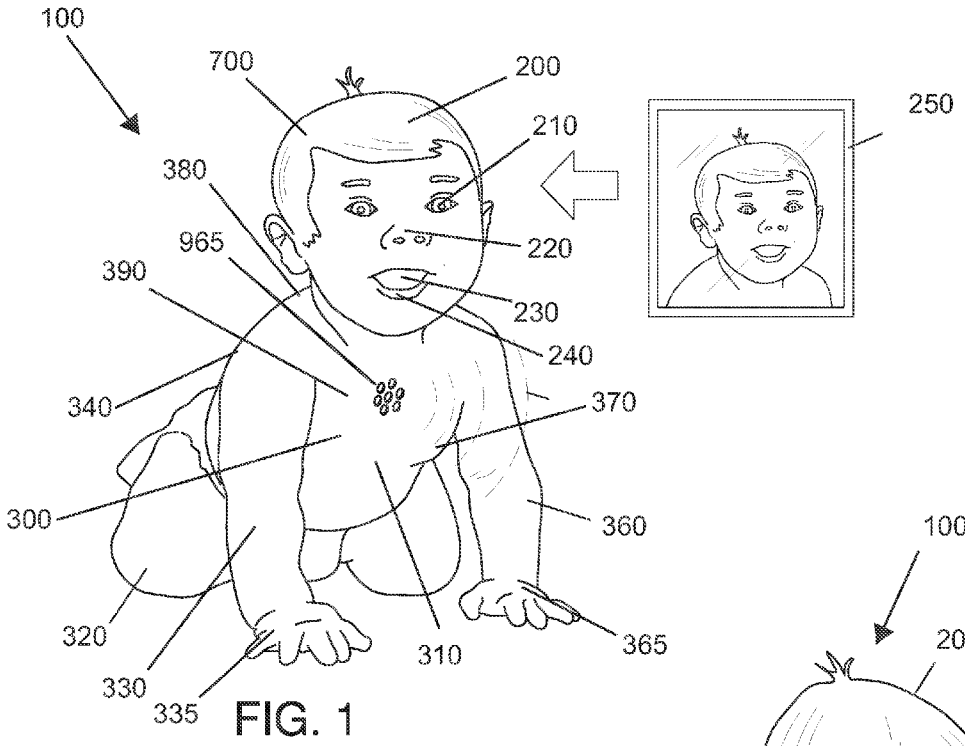
FIG. 1 is a perspective view of the present invention.
Figure 2:
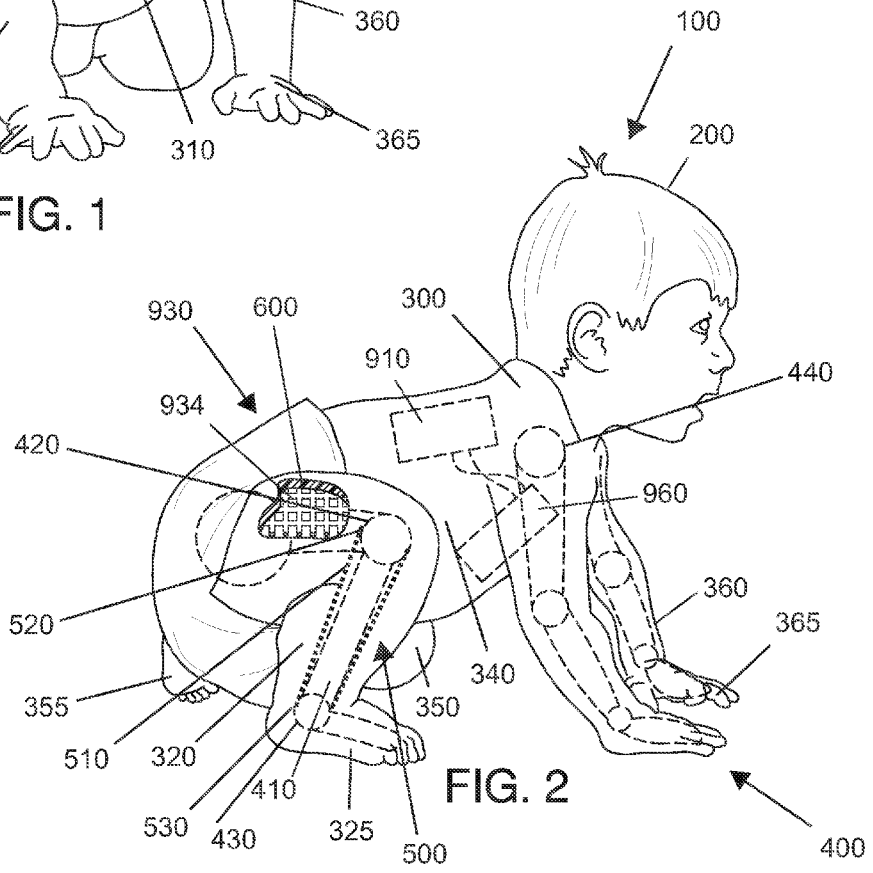
FIG. 2 is a side view of the present invention.
Figure 3:
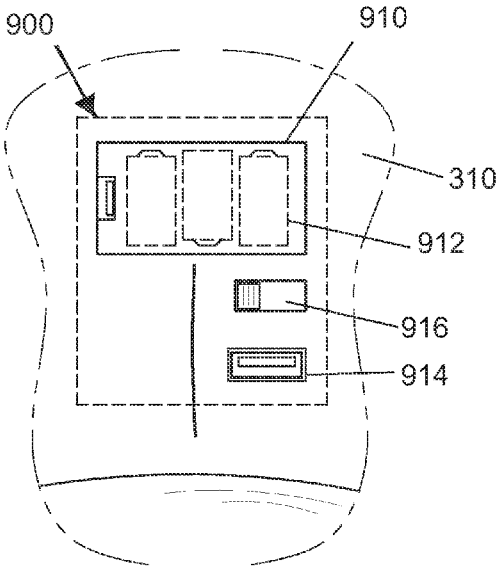
FIG. 3 is a rear view of the function simulation system of the present invention.
Figure 4:
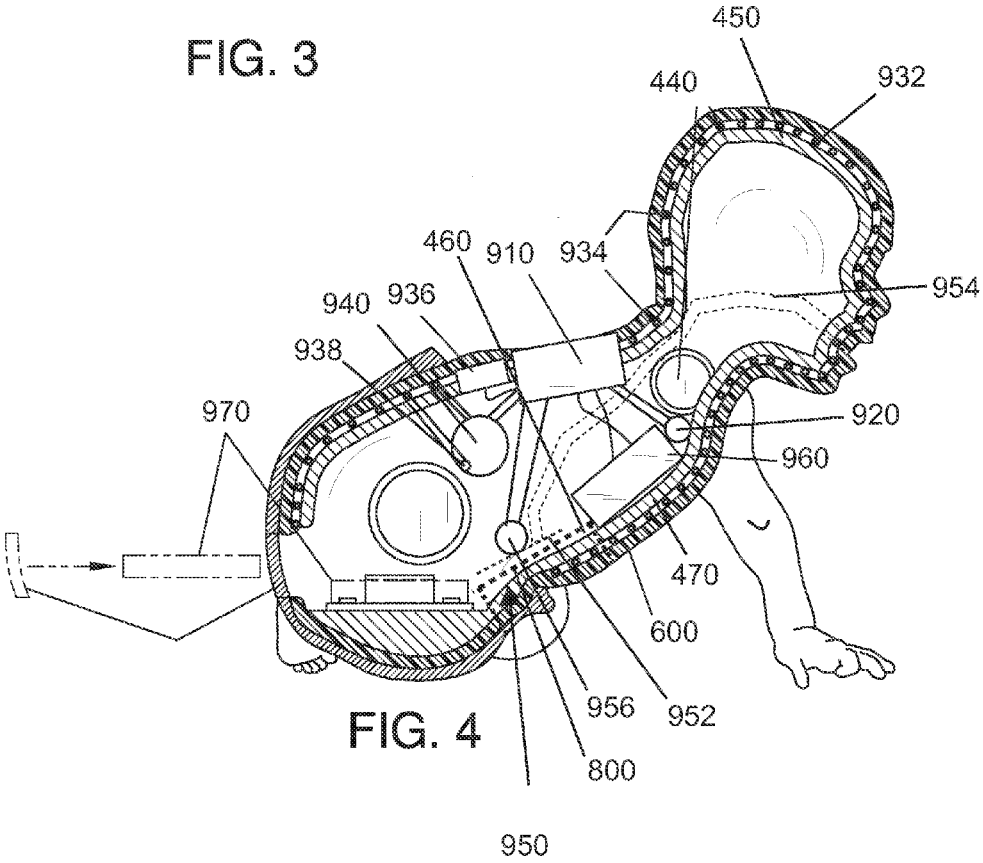
FIG. 4 is a cross sectional view of the present invention.
Figure 5:
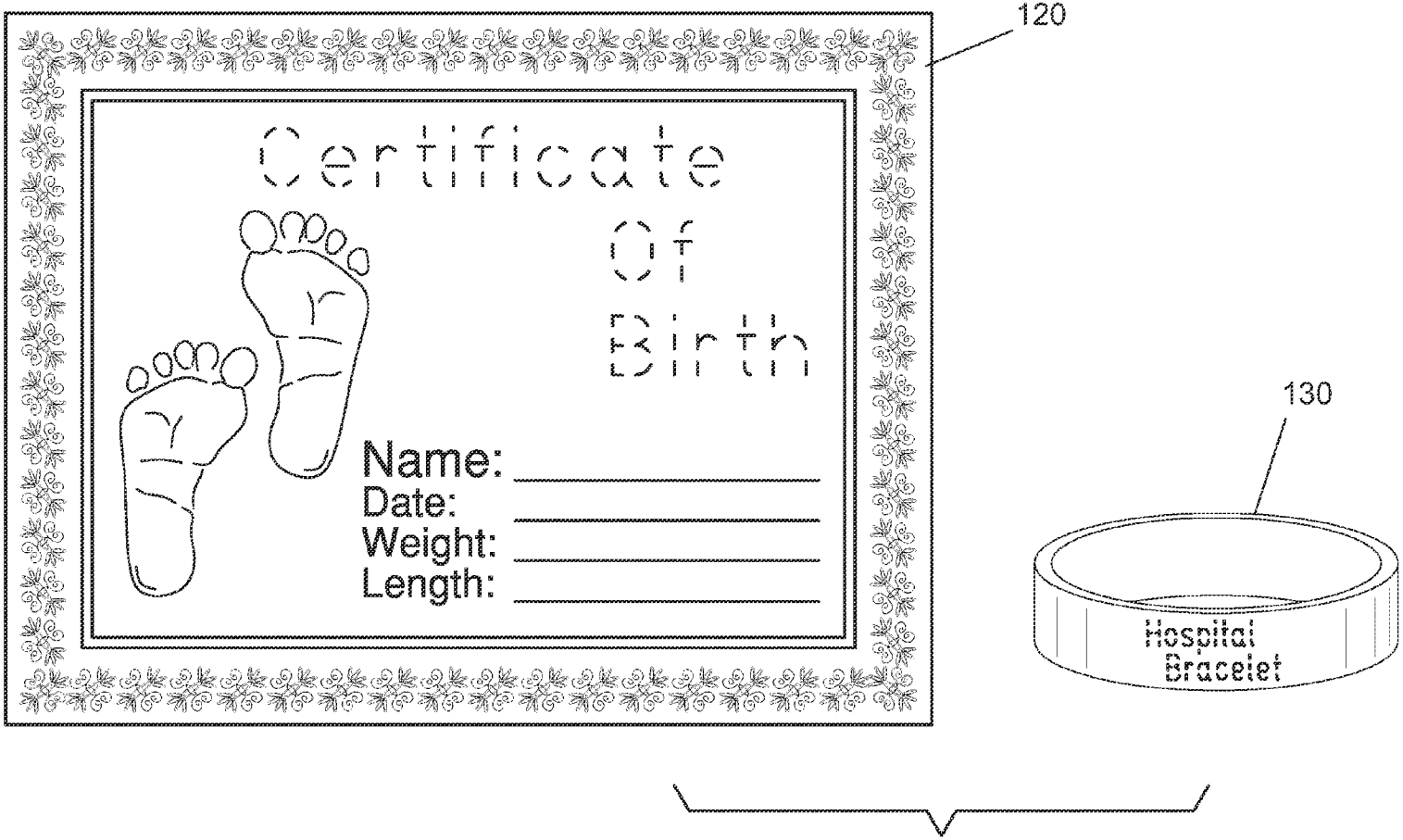
FIG. 5 is a view of some components of the present invention.

Referring now to FIG. 1-5, the present invention features a novel infant mannequin system (100) for documenting features of a specific human infant comprising a humanoid infant head form (200) having a generally spherical, generally bilaterally symmetrical shape about a sagittal plane. In some embodiments, the head form (200) comprises two eye members (210) having a form and coloring located thereon that generally resemble a specific human infant. In some embodiments, the head form (200) comprises a nose member (220) having two apertures located in the nose member (220) having a form that generally resembles a specific human infant. In some embodiments, the head form (200) comprises a mouth aperture (230) having two lips (240) located on en edge of the mouth aperture (230) having a form that generally resembles a specific human infant. In some embodiments, the head form (200) comprises a form that generally resembles a specific human infant. In some embodiments, a facial image (250) of a specific human infant is located on the head form (200). In some embodiments, the facial image (250) of a specific human infant is printed on the head form (200).

In some embodiments, the system (100) comprises a humanoid infant body form (300) having a generally bilaterally symmetrical shape about a sagittal plane. In some embodiments, the body form (300) comprises a torso (310) having a first leg (320) and a first arm (330) located on a torso first side (340) and a second leg (350) and a second arm (360) located on a torso second side (370). In some embodiments, a first hand (335) is located on the first arm (330) and a second hand (365) is located on the second arm (360). In some embodiments, a first foot (325) is located on the first leg (320), and a second foot (355) is located on the second leg (350). In some embodiments, the head form (200) is located at a torso top (380). In some embodiments, the head form (200) is attached to the torso top (380) in a rotational manner. In some embodiments, the head form (200) is attached to the torso top (380) in a rotational manner. In some embodiments, the rotation is limited to an arc of rotation that resembles a specific human infant. In some embodiments, the body form (300) comprises a form that generally resembles a specific human infant.

In some embodiments, the system (100) comprises a humanoid skeletal structure (400) having a generally bilaterally symmetrical shape about a sagittal plane. In some embodiments, the skeletal structure (400) comprises a plurality of rigid members (410). In some embodiments, the rigid member (410) comprises a movable joint (440) located on one or more ends. In some embodiments, the skeletal structure (400) further comprises a hollow skull member (450), and a hollow torso skeletal member (470). In some embodiments, the rigid members (410) are located together via the movable joints (440). In some embodiments, a plurality of rigid members (410), the torso skeletal member (470), and the skull member (450) are located together via movable joints (440) to comprise a skeletal structure (400) form that resembles a specific human infant.

In some embodiments, the system (100) comprises a humanoid muscular structure (500) having a generally bilaterally symmetrical shape about a sagittal plane. In some embodiments, the muscular structure (500) comprises a plurality of elastic members (510). In some embodiments, the elastic member (510) comprises an elastic member first end (520) and an elastic member second end (530). In some embodiments, the elastic member first, end (520) is located on a rigid member first connection point (420) and the elastic member second end (530) is located on a rigid member second connection point (430), in some embodiments, the elastic members (510) serve to provide a degree of poseable stiffness to the movable joints (440). In some embodiments, the movable joints (440) are stiff. In some embodiments, the muscular structure (500) comprises a form that resembles a specific human infant.

In some embodiments, the system (100) comprises a humanoid skin covering (600) located over and fully enveloping the skeletal structure (400) and the muscular structure (500). In some embodiments, the skin covering (600) is constructed from a silicone rubber, in some embodiments, the skin covering (600) comprises a color, a texture, an elasticity, a thickness, and a form that resembles a specific human infant.

In some embodiments, the system (100) comprises a hair receptacle system (700). In some embodiments, the hair receptacle system (700) is located on the skin covering (600), in some embodiments, the hair receptacle system (700) is located on the head form (200). In some embodiments, the hair receptacle system (700) is for receiving, holding, positioning and displaying a lock of human infant hair. In some embodiments, the hair receptacle system (700) comprises the human hair of a specific infant. In some embodiments, the hair receptacle system (700) is for receiving, holding, positioning and displaying a plurality of locks of human infant hair. In some embodiments, a hair receptacle system (700) comprises a color, a texture and a form that resembles a specific human infant.

In some embodiments, the hair receptacle system (700) comprises a clamp. In some embodiments, the hair receptacle system (700) comprises an adhesive.

In some embodiments, the system (100) comprises an abdomen compression diaphragm (800) located on the skeletal structure (400). In some embodiments, the abdomen compression diaphragm (800) is located underneath the skin covering (600). In some embodiments, the abdomen compression diaphragm (800) spans an abdominal cavity front opening (460). In some embodiments, the abdomen compression diaphragm (800) is elastically compressible. In some embodiments, the abdomen compression diaphragm (800) comprises a form and a function that resembles a specific human infant. In some embodiments, the abdomen compression diaphragm (800) works in conjunction with the abdominal expansion system (950).

In some embodiments, the system (100) comprises a function simulation system (900) comprising a microprocessor (910), a power source (912), a data port (914), and an activation switch (916) located in the torso (310). In some embodiments, the microprocessor (910) is operatively connected to the data port (914), and the activation switch (916). In some embodiments, the activation switch (916) is operatively connected to the power source (912). In some embodiments, the function simulation system (900) is operated via a mobile phone, a computer, or a remote control device. In some embodiments, the function simulation system (900) comprises radio wave communication technology (Bluetooth™, Wi-Fi, etc.). In some embodiments, the function simulation system (900) is programmable via a keypad located on the torso (310). In some embodiments, the function simulation system (900) is programmable via files transferred through the data port (914).

In some embodiments, the function simulation system (900) further comprises a heartbeat output simulator (920) located in the torso (310). In some embodiments, the heartbeat output simulator (920) is located underneath the skin covering (600). In some embodiments, the heartbeat output simulator (920) is operatively connected to the microprocessor (910). In some embodiments, the heartbeat output simulator (920) produces a function of a rhythmic beat in a torso chest area (390) that resembles a specific human infant.

In some embodiments, the function simulation system (900) further comprises a thermal circulation system (930). In some embodiments, a temperature controlled circulation fluid (932) is located in a capillary network (934). In some embodiments, the capillary network (934) is located beneath the skin covering (600). In some embodiments, the circulation fluid (932) is propelled through the capillary network (934) via a circulation fluid pump (940) located in the torso (310). In some embodiments, the circulation fluid pump (940) is operatively connected to the microprocessor (910). In some embodiments, the thermal circulation system (930) further comprises a heater (936) located in the torso (310). In some embodiments, the heater (936) heats the circulation fluid (932) to a specified value. In some embodiments, the heater (936) is operatively connected to the microprocessor (910). In some embodiments, the thermal circulation system (930) further comprises a temperature sensor (938) located in the torso (310). In some embodiments, the temperature sensor (938) monitors the temperature of the circulation fluid (932). In some embodiments, the temperature sensor (938) is operatively connected to the microprocessor (910). In some embodiments, the thermal circulation system (930) produces a function of a regulated temperature of the skin covering (600) that resembles a specific human infant. In some embodiments, the circulation fluid (932) is water. In some embodiments, the circulation fluid (932) is non-toxic heat transfer oil.

In some embodiments, the thermal circulation system (930) comprises electrical resistance wire located beneath the skin covering (600) operatively connected to the microprocessor (910).

In some embodiments, the function simulation system (900) further comprises an abdominal expansion system (950) located in the torso (310). In some embodiments, the abdominal expansion system (950) further comprises an abdominal bladder assembly (952) located against and operatively interfacing with the abdomen compression diaphragm (800). In some embodiments, the abdominal expansion system (950) further comprises connective tubing (954) fluidly connecting the mouth aperture (230) and the abdominal bladder assembly (952). In some embodiments, the abdominal expansion system (950) further comprises an abdominal electric motor (956) located in the torso (310). In some embodiments, the abdominal electric motor (956) is operatively connected to the microprocessor (910). In some embodiments, upon activation of the abdominal electric motor (956) the abdominal bladder assembly (952) rhythmically expands and contracts the abdomen compression diaphragm (800). In some embodiments, the abdominal bladder assembly (952) further draws in air through the mouth aperture (230), and then alternately expels air through the mouth aperture (230) via the connective tubing (954). In some embodiments, the abdominal expansion system (950) produces a function of a moving abdomen and a breathing simulation that resembles a specific human infant.

In some embodiments, the function simulation system (900) further comprises a sound generator (960) located in the torso (310). In some embodiments, the sound generator (960) is operatively connected to the microprocessor (910) and comprises a speaker. In some embodiments, upon activation, the sound generator (960) produces a function of reproducing recorded sounds emulating baby noises that resemble a specific human infant. In some embodiments, the sound generator (960) comprises a sound recorder.

In some embodiments, the system (100) comprises a body weight distribution member (970). In some embodiments, a body weight distribution member (970) is located in the skeletal structure (400). In some embodiments, the body weight distribution member (970) produces a function of simulating the weight of an infant in an area located therein. In some embodiments, the body weight distribution member (970) comprises a weight that resembles a specific human infant. In some embodiments, multiple body weight distribution members (970) are located throughout the skeletal structure (400). In some embodiments, the body weight distribution member (970) is fluid filled.

In some embodiments, the system (100) comprises a birth record (120) or a simulated birth certificate copy. In some embodiments, the system (100) comprises the hospital bracelet (130) given to the specific infant from when the day the specific infant was born.

As used herein, the term "about" refers to plus or minus 10% of the referenced number. For example, an embodiment wherein the body form is about 10 inches in length includes a body form that is between 9 and 11 inches in length.

The disclosures of the following U.S. patents are incorporated in their entirety by reference herein: U.S. Pat. No. 4,795,397; U.S. Pat. No. 5,257,955; U.S. Pat. No. 5,403,224; U.S. Pat. No. 5,607,337; U.S. Pat. No. 5,842,900; U.S. Pat. No. 5,947,791; U.S. Pat. Pub. No. 2008/0090490; U.S. Design Pat. No. 388,480; U.S. Design Pat. No. 560,732.

Various modifications of the invention, in addition to those described herein, will be apparent to those skilled in the art from the foregoing description. Such modifications are also intended to fail within the scope of the appended claims. Each reference cited in the present application is incorporated herein by reference in its entirety.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims.

The reference numbers recited in the below claims are solely for ease of examination of this patent application, and are exemplary, and are not intended in any way to limit the scope of the claims to the particular features having the corresponding reference numbers in the drawings.

What is claimed is:

1. A novel infant mannequin system (100) for documenting features of a specific human infant comprising:

(a) a humanoid infant head form (200) having a generally spherical, generally bilaterally symmetrical shape about a sagittal plane, wherein the head form (200) comprises two eye members (210) having a form and coloring disposed thereon that generally resemble the specific human infant, wherein the head form (200) comprises a nose member (220) having two apertures disposed therein having a form that generally resembles the specific human infant, wherein the head form (200) comprises a mouth aperture (230) having two lips (240) disposed on an edge thereon having a form that generally resembles the specific human infant, wherein the head form (200) comprises a form that generally resembles the specific human infant, wherein a facial image (250) of the specific human infant is disposed on the head form (200);

(b) a humanoid infant body form (300) having a generally bilaterally symmetrical shape about a sagittal plane, wherein the body form (300) comprises a torso (310) having a first leg (320) and a first arm (330) disposed on a torso first side (340) and a second leg (350) and a second arm (360) disposed on a torso second side (370), wherein a first hand (335) is disposed on the first arm (330) and a second hand (365) is disposed on the second arm (360), wherein a first foot (325) is disposed on the first leg (320), wherein a second foot (355) is disposed on the second leg (350), wherein the head form (200) is disposed at a torso top (380), wherein the body form (300) comprises a form that generally resembles the specific human infant;

(c) a humanoid skeletal structure (400) having a generally bilaterally symmetrical shape about a sagittal plane, wherein the skeletal structure (400) comprises a plurality of rigid members (410), wherein the rigid member (410) comprises a movable joint (440) disposed thereon, wherein the skeletal structure (400) further comprises a hollow skull member (450), and a hollow torso skeletal member (470), wherein the plurality of rigid members (410) are disposed together via the movable joints (440), wherein the plurality of rigid members (410), the torso skeletal member (470), and the skull member (450) are disposed together via movable joints (440) to comprise the skeletal structure (400) form that resembles the specific human infant;

(d) a humanoid muscular structure (500) having a generally bilaterally symmetrical shape about a sagittal plane, wherein the muscular structure (500) comprises a plurality of elastic members (510), wherein the elastic member (510) comprises an elastic member first end (520) and an elastic member second end (530), wherein the elastic member first end (520) is disposed on a rigid member first connection point (420), wherein the elastic member second end (530) is disposed on a rigid member second connection point (430), wherein the plurality of elastic members (510) serve to provide a degree of poseable stiffness to the movable joints (440), wherein the muscular structure (500) comprises a form that resembles the specific human infant;

(e) a humanoid skin covering (600) disposed over and fully enveloping the skeletal structure (400) and the muscular structure (500), wherein the skin covering (600) is constructed from a silicone rubber, wherein the skin covering (600) comprises a color, a texture, an elasticity, a thickness, and a form that resembles the specific human infant;

(f) a hair receptacle system (700), wherein the hair receptacle system (700) is disposed on the skin covering (600), wherein the hair receptacle system (700) is disposed on the head form (200), wherein the hair receptacle system (700) is for receiving, holding, positioning and displaying a lock of human infant hair, wherein the hair receptacle system (700) comprises the human hair of the specific infant, wherein the hair receptacle system (700) comprises a color, a texture and a form that resembles the specific human infant;

(g) an abdomen compression diaphragm (800) disposed on the skeletal structure (400), wherein the abdomen compression diaphragm (800) is disposed underneath the skin covering (600), wherein the abdomen compression diaphragm (800) spans an abdominal cavity front opening (460), wherein the abdomen compression diaphragm (800) is elastically compressible, wherein the abdomen compression diaphragm (800) comprises a form, and a function that resembles the specific human infant;

(h) a function simulation system (900) comprising a microprocessor (910), a power source (912), a data port (914) and an activation switch (916) disposed in the torso (310), wherein the microprocessor (910) is operatively connected to the data port (914), and the activation switch (916), wherein the activation switch (916) is operatively connected to the power source (912), wherein the function simulation system (900) further comprises:

(i) a heartbeat output simulator (920) disposed in the torso (310), wherein the heartbeat output simulator (920) is disposed underneath the skin covering (600), wherein the heartbeat output simulator (920) is operatively connected to the microprocessor (910), wherein the heartbeat output simulator (920) produces a function of a rhythmic beat in a torso chest area (390) that resembles the specific human infant, (ii) a thermal circulation system (930), wherein a temperature controlled circulation fluid (932) is disposed in a capillary network (934), wherein the capillary network (934) is disposed beneath the skin covering (600), wherein the circulation fluid (932) is propelled through the capillary network (934) via a circulation fluid pump (940) disposed in the torso, wherein the circulation fluid pump (940) is operatively connected to the microprocessor (910), wherein the thermal circulation system (930) further comprises a heater (936) disposed in the torso (310), wherein the heater (936) heats the circulation fluid to a specified value, wherein the heater (936) is operatively connected to the microprocessor (910), wherein the thermal circulation system (930) further comprises a temperature sensor (938) disposed in the torso (310), wherein the temperature sensor (930) monitors the temperature of the circulation fluid (932), wherein the temperature sensor (930) is operatively connected to the microprocessor (910), wherein the thermal circulation system (930) produces a function of a regulated temperature of the skin covering (600) that resembles the specific human infant, (iii) an abdominal expansion system (950) disposed in the torso (310), wherein the abdominal expansion system (950) further comprises an abdominal bladder assembly (952) disposed against and operatively interfacing with the abdomen compression diaphragm (800), wherein the abdominal expansion system (950) further comprises connective tubing (954) fluidly connecting the mouth aperture (230) and the abdominal bladder assembly (952), wherein the abdominal expansion system (950) further comprises an abdominal electric motor (956) disposed in the torso (310), wherein the abdominal electric motor (956) is operatively connected to the microprocessor (910), wherein upon activation of the abdominal electric motor (956) the abdominal bladder assembly (952) rhythmically expands and contracts the abdomen compression diaphragm (800), wherein the abdominal bladder assembly (952) further draws in air through the mouth aperture (230), then alternately expels air through the mouth aperture (230) via the connective tubing (954), wherein the abdominal expansion system (950) produces a function of a moving abdomen and a breathing simulation that resembles the specific human infant, (iv) a sound generator (960) disposed in the torso (310), wherein the sound generator (960) is operatively connected to the microprocessor (910) and comprises a speaker (965), wherein upon activation, the sound generator (960) produces a function of reproducing recorded sounds emulating baby noises that resemble the specific human infant, (i) a body weight distribution member (970), wherein the body weight distribution member (970) is disposed in the skeletal structure (400), wherein the body weight distribution member (970) produces a function of simulating the weight of an infant in an area disposed therein, wherein the body weight distribution member (970) comprises a weight that resembles the specific human infant;

wherein the thermal circulation system (930) comprises electrical resistance wire disposed beneath the skin covering (600) operatively connected to the microprocessor (910).

2. A novel infant mannequin system (100) for documenting features of a specific human infant comprising:

(a) a humanoid infant head form (200) having a generally spherical, generally bilaterally symmetrical shape about a sagittal plane, wherein the head form (200) comprises two eye members (210) having a form and coloring disposed thereon that generally resemble the specific human infant, wherein the head form (200) comprises a nose member (220) having two apertures disposed therein having a form that generally resembles the specific human infant, wherein the head form (200) comprises a mouth aperture (230) having two lips (240) disposed on an edge thereon having a form that generally resembles the specific human infant, wherein the head form (200) comprises a form that generally resembles the specific human infant, wherein a facial image (250) of the specific human infant is disposed on the head form (200);

(b) a humanoid infant body form (300) having a generally bilaterally symmetrical shape about a sagittal plane, wherein the body form (300) comprises a torso (310) having a first leg (320) and a first arm (330) disposed on a torso first side (340) and a second leg (350) and a second arm (360) disposed on a torso second side (370), wherein a first hand (335) is disposed on the first arm (330) and a second hand (365) is disposed on the second arm (360), wherein a first foot (325) is disposed on the first leg (320), wherein a second foot (355) is disposed on the second leg (350), wherein the head form (200) is disposed at a torso top (380), wherein the body form (300) comprises a form that generally resembles the specific human infant;

(c) a humanoid skeletal structure (400) having a generally bilaterally symmetrical shape about a sagittal plane, wherein the skeletal structure (400) comprises a plurality of rigid members (410), wherein the rigid member (410) comprises a movable joint (440) disposed thereon, wherein the skeletal structure (400) further comprises a hollow skull member (450), and a hollow torso skeletal member (470), wherein the plurality of rigid members (410) are disposed together via the movable joints (440), wherein the plurality of rigid members (410), the torso skeletal member (470), and the skull member (450) are disposed together via movable joints (440) to comprise the skeletal structure (400) form that resembles the specific human infant;

(d) a humanoid muscular structure (500) having a generally bilaterally symmetrical shape about a sagittal plane, wherein the muscular structure (500) comprises a plurality of elastic members (510), wherein the elastic member (510) comprises an elastic member first end (520) and an elastic member second end (530), wherein the elastic member first end (520) is disposed on a rigid member first connection point (420), wherein the elastic member second end (530) is disposed on a rigid member second connection point (430), wherein the plurality of elastic members (510) serve to provide a degree of poseable stiffness to the movable joints (440), wherein the muscular structure (500) comprises a form that resembles the specific human infant;

(e) a humanoid skin covering (600) disposed over and fully enveloping the skeletal structure (400) and the muscular structure (500), wherein the skin covering (600) is constructed from a silicone rubber, wherein the skin covering (600) comprises a color, a texture, an elasticity, a thickness, and a form that resembles the specific human infant;

(f) a hair receptacle system (700), wherein the hair receptacle system (700) is disposed on the skin covering (600), wherein the hair receptacle system (700) is disposed on the head form (200), wherein the hair receptacle system (700) is for receiving, holding, positioning and displaying a lock of human infant hair, wherein the hair receptacle system (700) comprises the human hair of the specific infant, wherein the hair receptacle system (700) comprises a color, a texture and a form that resembles the specific human infant;

(g) an abdomen compression diaphragm (800) disposed on the skeletal structure (400), wherein the abdomen compression diaphragm (800) is disposed underneath the skin covering (600), wherein the abdomen compression diaphragm (800) spans an abdominal cavity front opening (460), wherein the abdomen compression diaphragm (800) is elastically compressible, wherein the abdomen compression diaphragm (800) comprises a form, and a function that resembles the specific human infant;

(h) a function simulation system (900) comprising a microprocessor (910), a power source (912), a data port (914) and an activation switch (916) disposed in the torso (310), wherein the microprocessor (910) is operatively connected to the data port (914), and the activation switch (916), wherein the activation switch (916) is operatively connected to the power source (912), wherein the function simulation system (900) further comprises:

(i) a heartbeat output simulator (920) disposed in the torso (310), wherein the heartbeat output simulator (920) is disposed underneath the skin covering (600), wherein the heartbeat output simulator (920) is operatively connected to the microprocessor (910), wherein the heartbeat output simulator (920) produces a function of a rhythmic beat in a torso chest area (390) that resembles the specific human infant, (ii) a thermal circulation system (930), wherein a temperature controlled circulation fluid (932) is disposed in a capillary network (934), wherein the capillary network (934) is disposed beneath the skin covering (600), wherein the circulation fluid (932) is propelled through the capillary network (934) via a circulation fluid pump (940) disposed in the torso, wherein the circulation fluid pump (940) is operatively connected to the microprocessor (910), wherein the thermal circulation system (930) further comprises a heater (936) disposed in the torso (310), wherein the heater (936) heats the circulation fluid to a specified value, wherein the heater (936) is operatively connected to the microprocessor (910), wherein the thermal circulation system (930) further comprises a temperature sensor (938) disposed in the torso (310), wherein the temperature sensor (930) monitors the temperature of the circulation fluid (932), wherein the temperature sensor (930) is operatively connected to the microprocessor (910), wherein the thermal circulation system (930) produces a function of a regulated temperature of the skin covering (600) that resembles the specific human infant, (iii) an abdominal expansion system (950) disposed in the torso (310), wherein the abdominal expansion system (950) further comprises an abdominal bladder assembly (952) disposed against and operatively interfacing with the abdomen compression diaphragm (800), wherein the abdominal expansion system (950) further comprises connective tubing (954) fluidly connecting the mouth aperture (230) and the abdominal bladder assembly (952), wherein the abdominal expansion system (950) further comprises an abdominal electric motor (956) disposed in the torso (310), wherein the abdominal electric motor (956) is operatively connected to the microprocessor (910), wherein upon activation of the abdominal electric motor (956) the abdominal bladder assembly (952) rhythmically expands and contracts the abdomen compression diaphragm (800), wherein the abdominal bladder assembly (952) further draws in air through the mouth aperture (230), then alternately expels air through the mouth aperture (230) via the connective tubing (954), wherein the abdominal expansion system (950) produces a function of a moving abdomen and a breathing simulation that resembles the specific human infant, (iv) a sound generator (960) disposed in the torso (310), wherein the sound generator (960) is operatively connected to the microprocessor (910) and comprises a speaker (965), wherein upon activation, the sound generator (960) produces a function of reproducing recorded sounds emulating baby noises that resemble the specific human infant, (i) a body weight distribution member (970), wherein the body weight distribution member (970) is disposed in the skeletal structure (400), wherein the body weight distribution member (970) produces a function of simulating the weight of an infant in an area disposed therein, wherein the body weight distribution member (970) comprises a weight that resembles the specific human infant;

wherein the body weight distribution member (970) is fluid filled.

* * * * *